United States Patent [19]

Lequesne

[11] Patent Number: 4,829,947

[45] Date of Patent: May 16, 1989

[54] VARIABLE LIFT OPERATION OF BISTABLE ELECTROMECHANICAL POPPET VALVE ACTUATOR

[75] Inventor: Bruno P. B. Lequesne, Royal Oak, Mich.

[73] Assignee: General Motors Corporation, Detroit, Mich.

[21] Appl. No.: 240,284

[22] Filed: Sep. 6, 1988

Related U.S. Application Data

[63] Continuation-in-part of Ser. No. 84,400, Aug. 12, 1987, Pat. No. 4,779,582.

[51] Int. Cl.[4] ..... F01L 9/04

[52] U.S. Cl. ..... 123/90.11; 251/129.10; 335/234

[58] Field of Search ..... 123/90.11; 251/129.10, 251/129.16, 129.07; 335/234

[56] References Cited

U.S. PATENT DOCUMENTS

| | | | |
|---|---|---|---|
| 1,471,861 | 10/1923 | Perrault | 123/90.11 |
| 3,202,886 | 8/1965 | Kramer | 235/234 |
| 3,504,315 | 8/1970 | Stanwell | 335/234 |
| 3,853,102 | 12/1974 | Myers et al. | 123/90.11 |
| 3,882,833 | 5/1975 | Longstaff et al. | 123/90.11 |
| 4,383,234 | 5/1983 | Yatsushiro et al. | 335/253 |
| 4,455,543 | 6/1984 | Pischinger et al. | 335/266 |
| 4,533,890 | 8/1985 | Patel | 335/234 |
| 4,614,170 | 9/1986 | Pischinger et al. | 123/90.11 |
| 4,749,167 | 6/1988 | Gottschal | 251/65 |

FOREIGN PATENT DOCUMENTS 8101626 6/1981 PCT Int'l Appl. .

OTHER PUBLICATIONS

SAE Paper 790119, "Helenoid Actuators-A New Concept in Extremely Fast Acting Solenoids".

*Primary Examiner*—E. Rollins Cross
*Attorney, Agent, or Firm*—Robert M. Sigler

[57] ABSTRACT

A valve actuating device for an internal combustion engine is operated with partial valve lift. The valve is spring biased toward a neutral central position but held in full open or closed positions by permanent magnets having associated coils. Normal activation of the valve between full open and closed positions is by activation of a coil to fully cancel the field of the associated magnet with a spring moving the valve to the other position. Partial lift operation comprises providing, with the valve in its closed position, a valve opening current to the valve opening coil to reduce the closing magnetic field but stopping the current before the valve reaches its full open position and providing a valve closing current to one of the coils to cause the return of the valve to its closed position. Two modes of partial lift operation are described: a first in which valve movement is continuous with valve opening duration substantially proportional to valve lift and a second in which the valve is moved to a stable half lift position, left in this position for an arbitrary duration, and pulled back into the closed position.

6 Claims, 4 Drawing Sheets

VARIABLE LIFT OPERATION OF BISTABLE ELECTROMECHANICAL POPPET VALVE ACTUATOR

BACKGROUND OF THE INVENTION

This is a continuation-in-part of my patent application entitled Bistable Electromechanical Poppet Valve Activator, filed Aug. 12, 1987 as U.S. Ser. No. 084,400 now U.S. Pat. No. 4,779,582 and assigned to the assignee of this application.

This invention relates to bistable electromechanical actuators such as those which may be used with intake and exhaust valves for the combustion chambers of an internal combustion engine. It particularly relates to the operation of such valves with a variable lift.

Such valves are customarily mechanically activated by a camshaft, which fixes valve opening and closing timing and thus opening duration and generally fixes valve lift, although a successful mechanical valve lift device is described in U.S. Pat. No. 4,638,773, entitled Variable Valve Lift/Timing Mechanism and issued to Duane J Bonvallet on Jan. 27, 1987. Several actuators using electromagnetic forces have been suggested in the prior art. The latter actuators, if practical, have potential for improving engine performance by providing control of intake and/or exhaust valve operation and thus making valve timing variable in engine operation; however, none suggested so far has been sufficiently practical to supplant the ordinary mechanical actuating schemes One type of electromagnetic valve actuating device which has been suggested is the solenoid. Conventional solenoids operate by electromagnetically generated attractive forces built by inducing a flux in a moving armature. The magnitude of these forces, however, decreases rapidly over the distance which the armature travels. In typical engine valve applications, this is equal to the valve lift of typically 10 mm, a comparatively large distance One proposed solution is the helenoid actuator suggested by A. H. Seilly in the SAE Paper No. 790119 entitled "Helenoid Actuators—A New Concept in Extremely Fast Acting Solenoids", published in 1979. In a helenoid actuator, a plunger is moved over a smaller gap with the displacement being amplified by a lever. The lever, however, adds mass to the system; and a large amount of energy is required to move the valve.

A magnet in the armature can help generate strong repulsion forces at the beginning of the armature motion, as shown in the U.S. Pat. Nos. to Kramer 3,202,886, issued Aug. 24, 1965, Stanwell 3,504,315, issued Mar. 31, 1970 and Patel 4,533,890, issued Aug. 6, 1985. However, the solenoid current level of these schemes is high, since it must generate sufficient force to overcome the magnetic attraction as well as to provide the kinetic energy of valve motion. In addition, due to the high seating velocity, braking means may be required for the valve.

Oscillating systems of the spring-mass type, for example, can store amounts of energy significantly larger than the small amount of energy required to overcome friction and spring losses. Solenoids can be used to latch such a system at either end of its stroke. In addition, magnetic forces from the solenoid can compensate for the losses of the system. Such a system is shown in the U.S. Pat. No. 4,455,543 to Pischinger et al, issued June 19, 1984. However, in the system of that patent, electrical energy is continuously consumed while the valve is latched in either of the open and closed positions. In addition, upon system initiation, provision must be made to preload the system by moving the valve against the springs to the open or closed position from a middle position to which it returns when neither solenoid is actuated. A third coil is proposed; and this adds to the complexity of the device. An alternative initialization method not requiring the third coil is proposed in the U.S. Pat. No. 4,614,170 to Pischinger et al. However, this method requires complex control routines and delays start up. In addition, since the valves are open in an intermediate position when the engine is off, Pischinger et al add an auxiliary valve (30 in FIG. 5), which further increases cost and complexity.

In my parent patent application U.S. Ser. No. 084,800, I disclosed a valve lift apparatus which retains the advantageous features of a solenoid latched spring-mass oscillating system but with reduced energy consumption and no need for preloading upon startup. It uses permanent magnets to latch the valve closing member into at least the closed position and, in some embodiments, the open position, against the force of compressed springs. Recently developed powerful permanent magnetic materials enable such magnets to be small and light. A coil associated with each position, when activated with a current, cancels the magnetic field of the permanent magnet pole holding the valve closing member and allows the compressed spring to move the member quickly through a central neutral position toward the other position, whereupon it is attracted by the other magnetic pole to compress the other spring and latch into the other position.

The operation of my valve lift apparatus as described in U.S. Ser. No. 084,800, however, was described only for full lift, in which the valve was allowed, by generating appropriate currents in the coils, to be moved by one of the springs swiftly through the center position to the other extreme open or closed position, where it is trapped by one of the permanent magnets. However, although it is not described in U.S. Ser. No. 084,800, the apparatus may also be operated with a partial lift.

SUMMARY OF THE INVENTION

The invention is a method of operating an electromechanical valve actuating device for an internal combustion engine in a partial lift mode, wherein the valve actuating device actuates a valve movable between a closed position against a valve seat and a full open position away from the valve seat and comprises spring means effective to bias the valve toward a neutral position between the closed and open positions, permanent magnet means for each of the closed and full open positions effective to retain the valve in the respective closed or full open position as it approaches either and a coil associated with each of the permanent magnet means and effective, when supplied with an electric current, to produce a magnetic field superimposed on that of the respective permanent magnet means and thus effective to modify the magnetic attraction of the respective permanent magnet means on the valve.

The method, in its broadest terms, comprises the following steps:

(1) establishing the valve in its closed position;

(2) providing, at a predetermined valve opening time, an opening electric current to the coil associated with the permanent magnet means for the closed position of the valve in direction to reduce the magnetic field thereof and allow the spring means to accelerate the valve toward the fully open position;

(3) stopping the opening electric current before the valve reaches its full open position; and (4) providing, when the opening electric current is stopped and before the valve reaches its full open position, a closing electric current to one of the coils associated with the permanent magnet means for the full open and closed positions of the valve in direction and amount to modify the magnetic field thereof to cause the valve to be returned to the closed position. Thus, the valve open duration is determined at least in part by the time duration between the initiation of the opening electric current and the initiation of the closing electric current.

The generic method as described above has at least two species. In the first, the opening electric current is in amount effective to substantially cancel the magnetic field of the permanent magnet means for the closed position of the valve; and the closing electric current is initiated substantially concurrently with the stoppage of the opening electric current. The valve is thus opened to a position short of the full open position and immediately closed again in a continuous movement, with valve lift linked with open duration.

In the second species, the opening electric current is in amount less than that required for full cancellation of the magnetic field of the permanent magnet means for the closed position of the valve and is stopped before the valve reaches the neutral position so that the valve stops in a stable half lift position near the neutral position determined by the amount of the opening electric current and the friction characteristics of the valve. The valve lift is thus determined by the half lift position.

DESCRIPTION OF THE PREFERRED EMBODIMENT

Apparatus and Full Lift Operation

Figure 1:
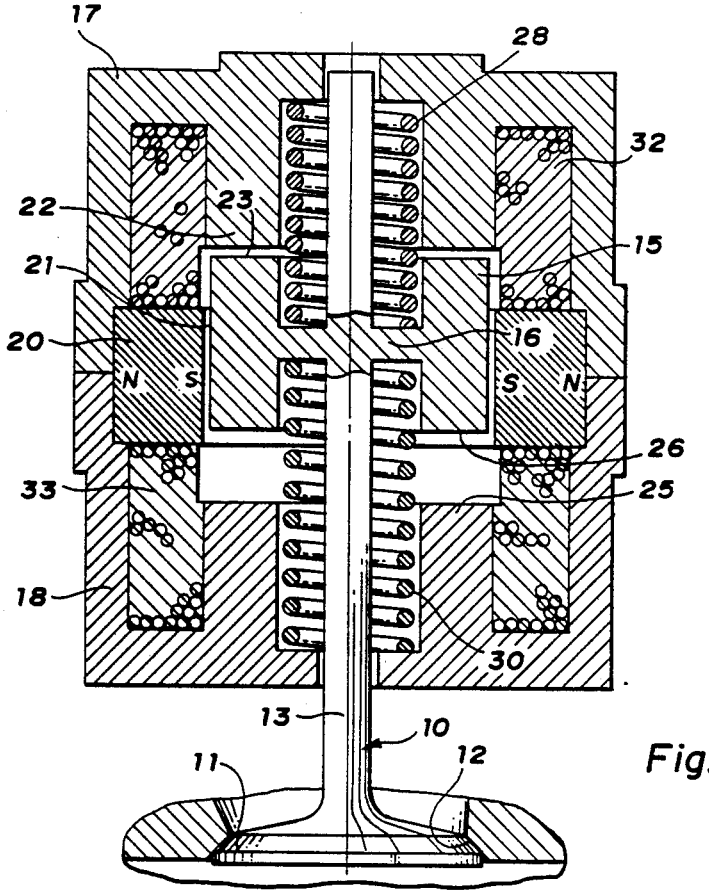
FIGS. 1, 2 and 3 show alternative single valve embodiments of a poppet valve apparatus for an internal combustion engine to be controlled by the method of this invention.
Figure 4:
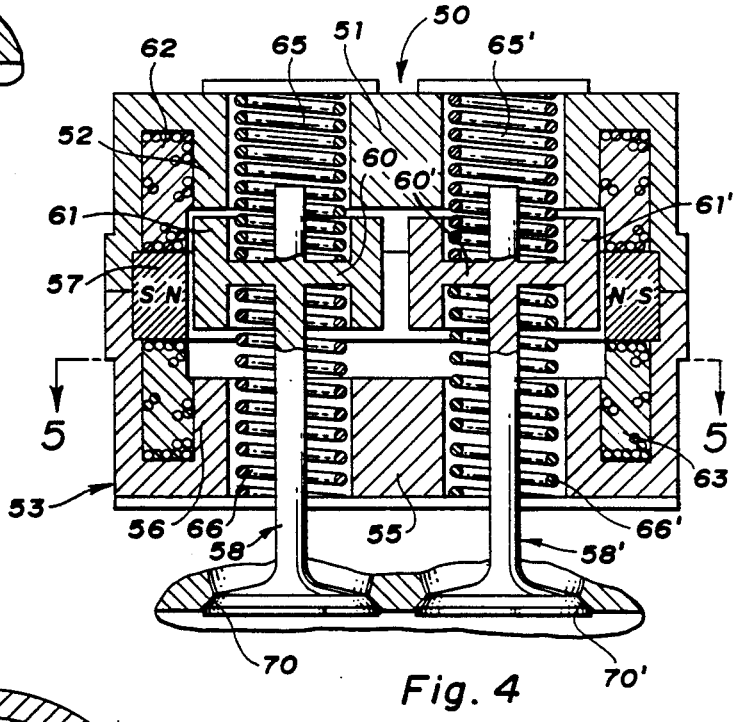
FIG. 4 shows a dual valve variation of the apparatus shown in FIG. 1.
Figure 5:
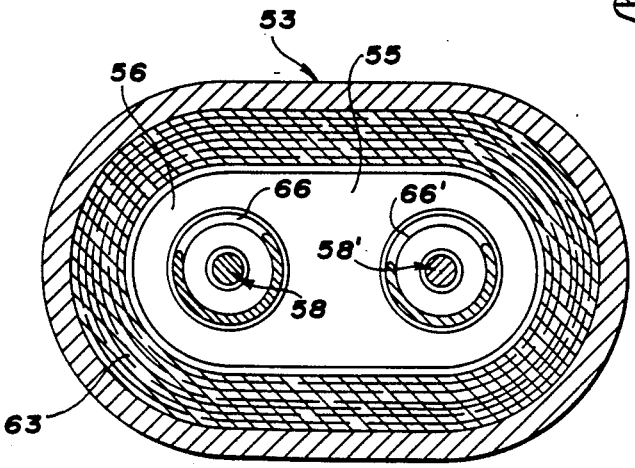
FIG. 5 is a section view along lines 5—5 in FIG. 4.

Referring to FIG. 1, a valve closing member 10 has a valve head 11 which, in a closed position, seats against and thereby closes an engine intake or exhaust port with a valve seat 12. Valve member 10 has a stem 13 including, at a point spaced from head 11, an annular plunger 15 made of magnetic material and attached to stem 13 by a circular plate 16. Upper and lower magnetic frame members 17 and 18, made of magnetic material, together comprise a magnetic frame and hold an annular permanent magnet 20 having radially inner and outer poles. The word "annular", as used in this specification and the following claims, is not to be restricted to a circular shape. Rectangular and other shapes may be used. Another non-circular example is shown in the embodiment of FIGS. 4, 5, to be described at a later point in this specification. Plunger 15, magnetic frame members 17, 18 and permanent magnet 20 together comprise a magnetic circuit having an annular radial air gap between the radially inner pole S of permanent magnet 20 and the radially outer surface 21 of plunger 15 which does not vary significantly with axial plunger movement. A variation of this structure not shown in the FIGS. but within the scope of the claims would include a thin annular sleeve of a magnetic material such as soft steel on the inner annular surface of magnet 20 adjacent plunger 15. The purpose of the sleeve would be to better distribute the flux of magnet 20, prevent local demagnetization of the magnet, protect the magnet from chipping or other physical damage and generally facilitate assembly of the unit.

Although it does not show in FIG. 1, plunger 15 is preferably made with a plurality of axial slots extending radially inward from the outer circumference through a substantial portion of the annular thickness thereof to reduce eddy current losses. For example, the use of twenty four evenly spaced slots has produced energy savings of as much as 39 percent. The slots should be made as thin as possible to be practical. The use of an Electric Discharge Machining (EDM) technique has produced slots as narrow as 0.004 inches, which removes a negligible amount of material from plunger 15.

The magnetic circuit further has an axial air gap between a first pole 22 formed by upper magnetic frame member 17 and the upper axial surface 23 and between a second pole 25 formed by lower magnetic frame member 18 and the lower axial surface 26. This compound magnetic circuit varies with plunger 15, and therefore valve member 10, position to produce the magnetic force curve 27 of FIG. 7.

An upper spring 28 is compressed between upper magnetic frame member 17 and plate 16 of valve member 10. A lower spring 30 is compressed between lower magnetic frame member 18 and plate 16. Springs 28 and 30 are preferably coil springs; although other types may be used. They combine to produce a spring force on valve member 10 as shown by curve 31 of FIG. 7, a force always tending to return valve member 10 toward a neutral position between the open and closed positions thereof. The combined forces oppose each other and cancel to form two stable positions for valve member 10: one in the closed position shown in FIG. 1, with plunger 15 adjacent pole 22 of magnetic frame member 17; the other in the open position, with plunger 15 adjacent pole 25 of lower magnetic frame member 18. There is a potential third stable position in the neutral position midway between the others. However, in normal operation, as will be seen, this position is never a final resting place for the apparatus, which may be considered a bistable device.

An upper coil 32 is wound around pole 22 of upper magnetic frame member 17; and a lower coil 33 is wound around pole 25 of lower magnetic frame member 18. Each of coils 32 and 33 is effective, when provided with a predetermined current pulse, to cancel the magnetic force of the adjacent pole, whereby the associated spring 28 or 30 imparts a rapid acceleration of valve member 10 out of its position adjacent the pole. The inertia of valve member 10 carries it well past the neutral position midway between the poles, a position it passes with maximum velocity. Although, on the other side of the neutral position, valve member 10 loses kinetic energy as it compresses the other of springs 28 and 30, it coasts sufficiently close to the opposite pole to be attracted thereto. It thus becomes latched in the opposite position until the opposite coil is activated to return valve member 10 in like manner to its original position.

Several advantages of the operation of this apparatus should be noted. First, although the spring delivers high initial acceleration to produce high kinetic energy in valve member 10 and thus quick movement thereof, the kinetic energy is converted back to potential energy by the other spring, which tends to brake valve member 10 before it seats in the opposite position. Secondly, no current is required to maintain valve member 10 in either latched position, so that overall energy consumption of the apparatus is low. Thirdly, the initial spring loading of the apparatus can be set in manufacturing with valve member 10 in one of the latched positions with no additional provision to periodically re-load the apparatus.

Figure 2:
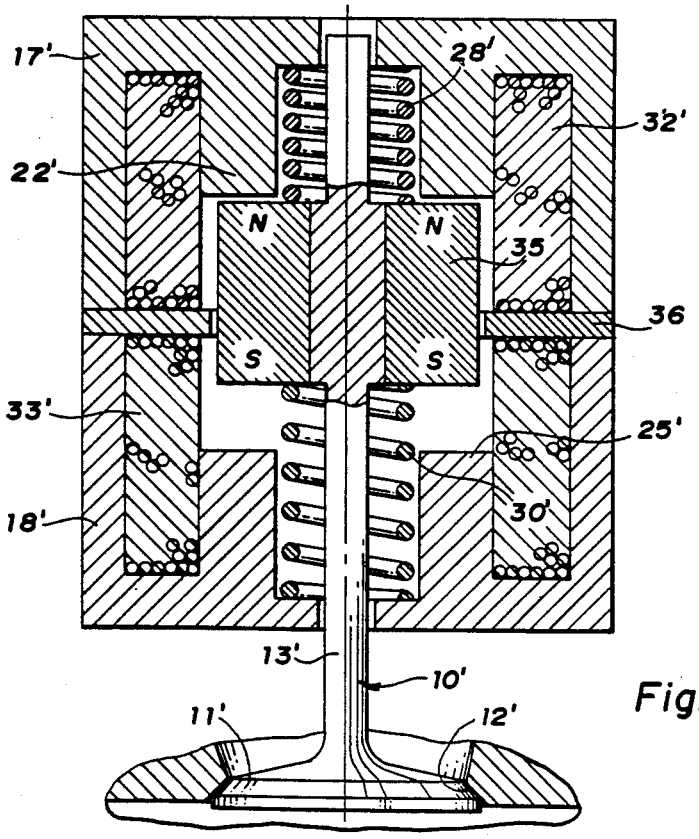

A variation of the apparatus of FIG. 1 is shown in FIG. 2. Members which are essentially unchanged are given similar primed reference numerals. In this embodiment, the permanent magnet 35 is an annular magnet mounted on valve stem 13', which takes the place of both plunger 15 and plate 16 of FIG. 1. An annular magnetic flux member 36 is placed between magnetic frame members 17 and 18 in place of permanent magnet 20 of FIG. 1 to complete the magnetic flux circuit. The operation of the apparatus of FIG. 2 is identical with that of FIG. 1, already described.

Figure 3:
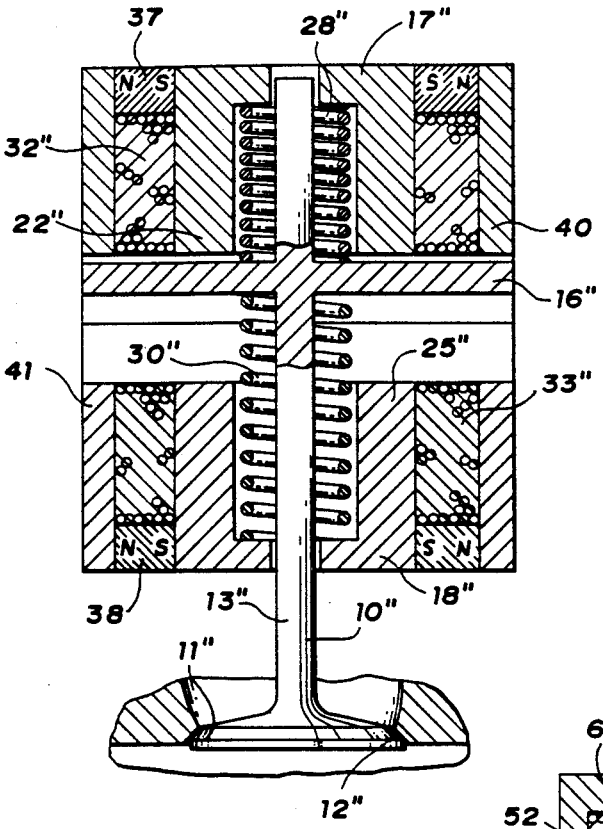

Another variation of the apparatus of FIG. 1 is shown in FIG. 3. In this embodiment, essentially similar elements are shown with double primed reference numerals. A pair of annular permanent magnets 37, 38 is provided, one magnet for each of magnetic frame members 17'' and 18'', which members are axially separated from each other. Plate 16'' is provided on valve stem 13'' as in the embodiment of FIG. 1; but it extends radially across the full radial extent of members 17 and 18 with no annular plunger attached. The operation of the apparatus of FIG. 3 is similar to that of FIGS. 1 and 2, with plate 16'' completing the magnetic circuit between inner annular pole 22'' and an outer annular pole 40 of magnetic frame member 17 at the upper limit of its travel and a magnetic circuit between inner annular pole 25'' and an outer annular pole 41 of magnetic frame member 18 at the lower limit of its travel, which limits correspond to the closed and open positions, respectively.

A variation of the embodiment of FIG. 3 is not separately shown, since it differs only in the replacement of permanent magnet 38 with a member of soft magnetic but not permanently magnetized material. Magnet 37 would still accomplish latching in the valve closed position and retain the valve closed after electric power is shut off. Since the type of valves involved are closed most of the time, most of the valves in an engine would be in the permanent magnet latched closed state at any given time. There would be an increased energy requirement for retention of the valves in the open position; but the overall solenoid cost would be lower.

The apparatus of FIGS. 4 and 5 is a dual valve embodiment of the invention, where the dual valves are both of the same type (i.e., intake or exhaust) but one is designed to open before the other. An upper magnetic frame member 50 defines a central pole 51 and outer annular pole 52. Similarly a lower magnetic frame member 53 defines a central pole 55 and an outer annular pole 56. Members 50 and 53 are joined together at their periphery and enclose an annular permanent magnet 57 positioned similarly to magnet 20 of FIG. 1. A pair of valves 58 and 58', which close against valve seats 70 and 70', respectively, have mounted thereon plates 60 and 60' and annular plungers 61 and 61', similarly to the arrangement of FIG. 1. A single upper coil 62 surrounds poles 51 and 52 of upper magnetic frame member 50; a single lower coil 63 surrounds poles 55 and 56 of magnetic frame member 53. Springs 65 and 66 urge valve 58 to a neutral position; while springs 65' and 66' urge valve 58' to a neutral position. However, each of valves 58 and 58' are bitable with a force characteristic as shown in curves 27 and 31 of FIG. 7; and the apparatus operates generally as does that of FIG. 1.

Figure 6:
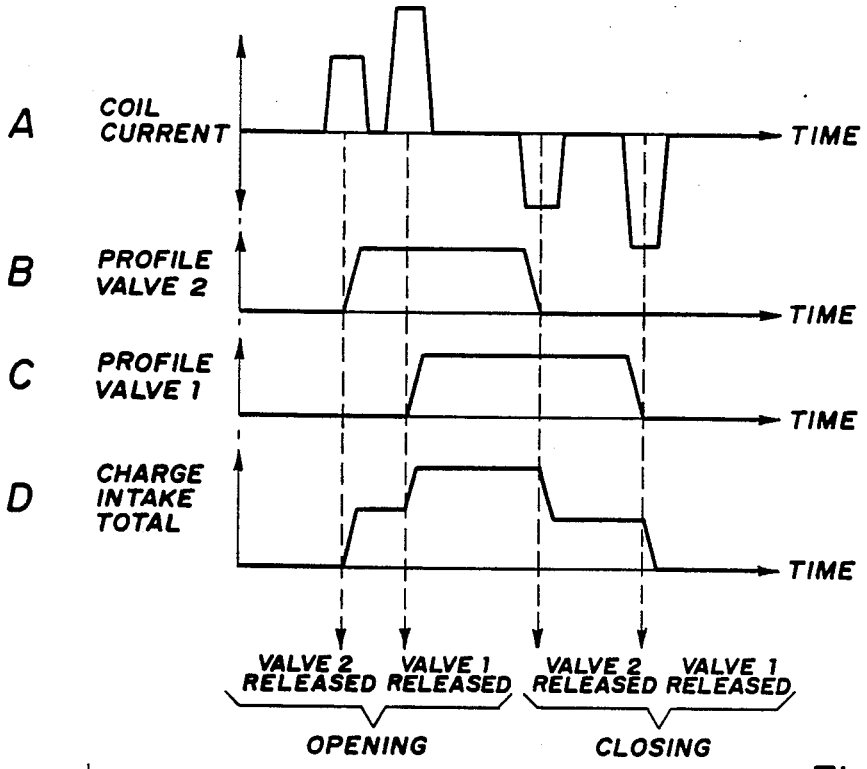
FIGS. 6A–6D show timing diagrams of various parameters illustrating the operation of the apparatus of FIGS. 4–5 in full lift operation.

However, not easily shown in FIGS. 4 and 5 is the fact that the springs, magnetic circuits and coils of the apparatus are designed to cause one of valves 58 and 58' to be released from one of its latched positions at a lower current level than the other is released from its similar latched position. To this end, the spring constants of springs 65 and 66, on one hand, and springs 65' and 66', on the other hand, may be different or the magnetic circuits for the two valves 58 and 58' may be different. Thus, a current through coil 62, for example, equal to the lower current should be sufficient to open valve 58, with a greater current through the same coil at a later time being effective to additionally open valve 58'. The operation is shown in the curves of FIGS. 6A–6D for opening and closing of the valves. FIG. 6A shows the coil current pulsed to a first maximum value to cause one of the valves to open, as shown in FIG. 6B. This is followed by a pulse to a larger maximum value which is sufficient to open the other valve as shown in FIG. 6C. The closing pulses and their results are shown in the same Figures. The overall charge intake total, assuming the valves are combustion chamber intake valves, is shown in FIG. 6D. Thus, a more complex valve opening profile is possible with control of valve and profile timing in a dual valve apparatus which is significantly more compact than dual solenoids.

It may be desirable, as part of the valve control for the apparatus of this invention, to provide a feedback signal indicating valve response to the activating currents of the coils. Since the apparatus has two coils—one to initiate valve opening and one to initiate valve closing—and only one is used at a time, the other coil is free to be used as a sensing coil. It is located in a position where it will change its inductance with motion of the valve apparatus and therefore will be effective to provide such feedback.

Figure 8:
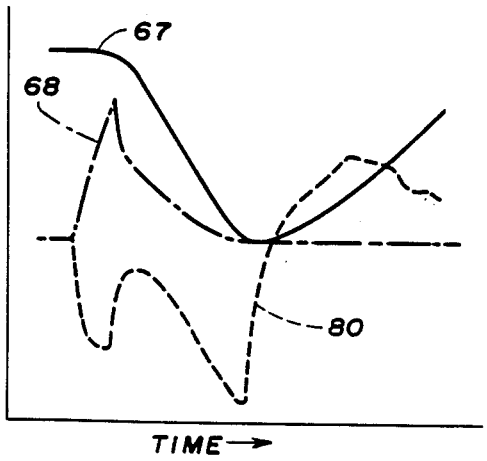
FIG. 8 is a timing diagram of various electrical parameters illustrating the use, in one of the embodiments of FIGS. 1–5, of the non-activated coil as a valve motion sensing feedback signal generating element.

FIG. 8 shows valve motion in curve 67, activating current in the activating coil in curve 68 and generated EMF in the sensing coil in curve 80 for a case in which the valve rebounds from the desired position back toward the original position instead of latching in the desired position. The zero levels of curves 68 and 80 are seen in the extreme left and right of curve 68. It should be noted that the sign of the EMF changes on the rebound and thus is an indication thereof. It should also be noted that the EMF just prior to rebound was quite high (in the negative direction), which would provide an indication that rebound was about to occur. The control could be designed to respond to such a signal by applying a braking force by temporarily and partially canceling the attractive magnetic force of the destination pole or by some other means, in order that rebound is prevented.

Partial Lift Operation

Figure 9:
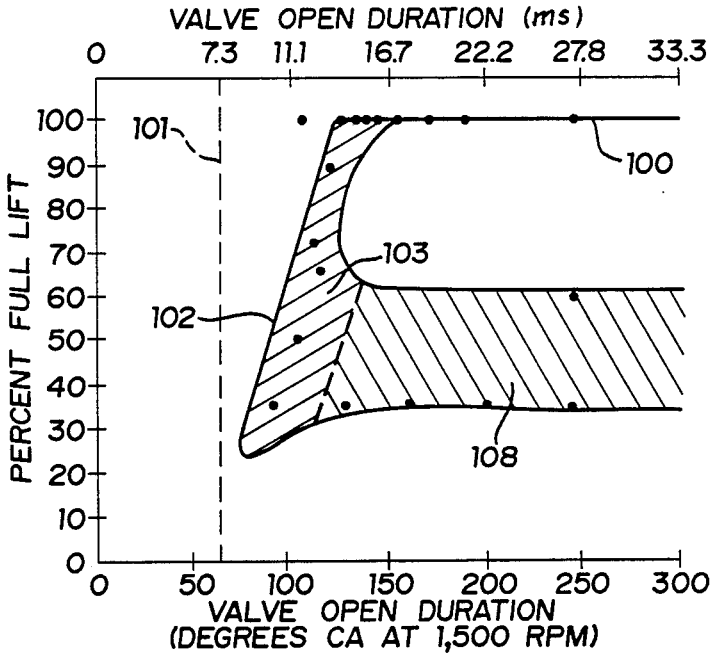
FIG. 9 is a diagram of peak lift vs. valve opening duration illustrating the possibilities of full and partial lift operation.

FIG. 9 shows the possible modes of operation of the apparatus described herein in terms of peak valve lift vs. valve opening duration as measured relative to the beginning of valve opening. The diagram is divided into different areas characterized by reference numbers. The dots in FIG. 9 correspond to operating points that have actually been tested and verified. The actuator works in the time domain, so that the crank angles indicated in FIG. 9 are based on a constant arbitrary engine rotational speed of 1,500 RPM.

Conventional full lift operation of the apparatus with variable open duration corresponds to a horizontal line region 100 at the 100 percent full lift value of 7.650 mm for the particular engine chosen. The duration can be expanded to the right in FIG. 9 as desired; but it is arbitrarily cut off at 33.3 ms at the right side of the FIG. There are two limits to short durations. One is an absolute limit below which this apparatus has not been seen to operate, which is determined by the physical principles of its operation and is shown as vertical line 101 at 7.3 ms. The second is somewhat longer and is determined by the maximum valve seating velocity that can be tolerated over a long time period without damage to the valve or valve seat. This maximum valve seating velocity was set at 1 m/s and is represented by diagonal line 102. The latter is the practical limit used herein.

There are two modes of partial valve lift possible for this apparatus. The first is indicated by area 103, which s indicated by the area having cross-hatching angled to the right in FIG. 9. This mode allows very short valve open durations but links the duration to peak lift in a substantially proportional relationship. In this mode, the valve opening is initiated normally by establishing an electric current in the coil associated with the permanent magnet means for the closed position of the valve, which is valve opening coil 32 of FIG. 1. This current is established in direction and amount to fully cancel the magnetic field of the permanent magnet in the valve closed pole 22. However, the valve opening is aborted early by stopping the current in coil 32 and immediately establishing a current in the other coil 33, associated with the permanent magnet means for the open position of the valve, to at least reduce and preferably fully cancel the permanent magnetic field in valve open pole 25 before valve 10 reaches its full open position. Valve 10 is thus decelerated and its motion reversed by spring 30 so that it returns past the neutral position to be attracted by magnetic pole 22 to its closed position, in which it is again retained with plunger 15 against pole 22. When the valve, having been turned around, has moved sufficiently close to the closed position to be much more attracted by pole 22 than by pole 25, the current in coil 33 may be stopped. It should also be noted that the valve closing might be accomplished, when current in coil 32 is stopped, by restarting current in coil 32 in the opposite direction to add to the magnetic force of pole 22 rather than subtracting from or cancelling the magnetic force of pole 25.

Figure 10:
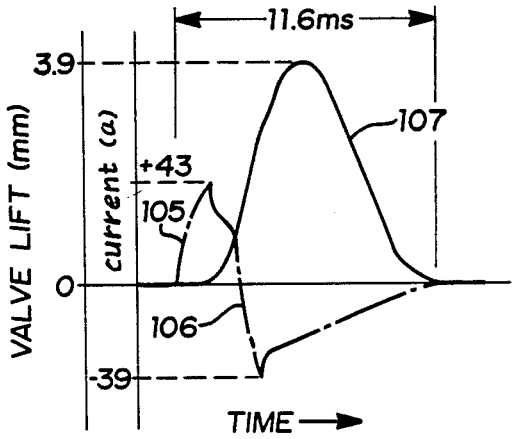
FIG. 10 is a timing diagram of coil current and valve position illustrating one mode of partial valve lift operation.

In this mode of operation, valve movement is continuous, with no controllable pause in any stable position while the valve is open. The peak lift is linked to the open duration in a substantially proportional relation: the later the initiation of the current pulse in coil 33 relative to the initiation of the current pulse in coil 32, the longer the valve open duration and the higher the peak lift. Some small variation is possible with adjustments in coil current levels and durations, which explains width of area 103; but the main advantage of this mode of operation is in the small valve durations possible with its use. The curves of FIG. 10 show the relative timing of current pulse 105 in coil 32, current pulse 106 in coil 33 and Valve movement in curve 107, with a peak lift of 3.9 mm, slightly more than half total possible lift in this example. The current curve 105, 106 was obtained with a single current sensor on a single current supply switched from one coil to the other at a predetermined time corresponding approximately to the point at which the current curve crosses the valve position curve.

The shortest duration for a given lift is limited by the valve seating velocity. For small valve lifts, the seating velocity is less due to the smaller distance over which the valve is accelerated on its return to the closed position. This can be seen in the fact that line 102, which represents the lower duration limit due to valve seating velocity, approaches line 101, which represents the absolute lower duration limit of the apparatus, at low valve lifts. Therefore, quite small valve open durations are possible using this method. These small valve open durations, combined with the small flow of the small valve opening due to the low valve lift, greatly extend the capacity of the apparatus to control the engine toward its low output region. Tests have showed that the range of load control toward the low end with this method is sufficient to reach zero percent engine output power, which means that the valves alone could be used for engine load control over the whole range of engine operation, if desired, which thus allows elimination of the conventional engine throttle valve. The energy requirements for this mode of operation proved smaller than those for full lift operation in the particular engine used for testing this invention.

The second mode of partial valve lift operation, which corresponds to region 108 in FIG. 9, comprises releasing the compressed valve opening spring 28 of FIG. 1 with energy just sufficient to allow the valve to reach and settle in a half lift position near the neutral center position and allow the valve to stay there until it is brought back to the closed position with a current pulse in coil 32 in direction to increase the magnetic flux of pole 22 or in coil 33 in direction to decrease the magnetic flux of pole 25, either tending to close the valve. Though the theoretical neutral point is exactly half of full lift, there is a small range of possible half lift stopping points about this position due to the inherent friction characteristics of the valve; and these different half lift points are reached, for a particular example of the mechanism with slightly different currents in the coil opening pulse. The lower valve energy is obtained by providing a smaller valve opening current than that required for full cancellation of the permanent magnetic field holding the valve closed.

Figure 11:
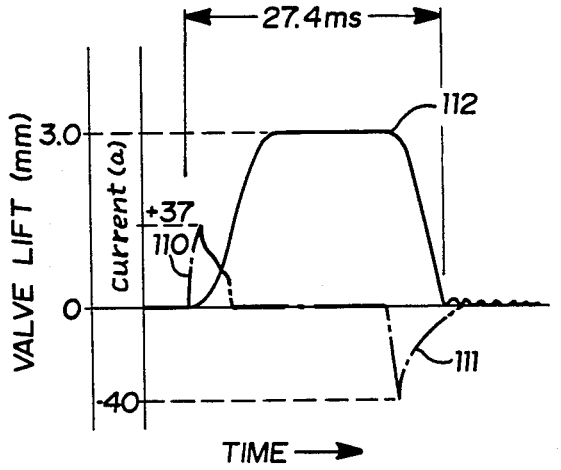
FIG. 11 is a timing diagram of coil current and valve position illustrating another mode of partial valve lift operation.

A typical operation of the second partial lift mode is shown in the curves of FIG. 11, with an opening current pulse 110 reaching 37 amps, a closing current pulse 111 of 40 amps applied to coil 32 in the opposite direction to aid the permanent magnet field in pulling the valve closed against spring 28, and a valve position curve 112 which shows the curve reaching and holding a half lift position of 3.0 mm before being pulled closed by current pulse 111. It is apparent that the valve may be left in the partial lift position as long as desired until current pulse 111 is initiated, although, once again, the region is arbitrarily cut off at 33.3 ms in FIG. 9.

Figure 7:
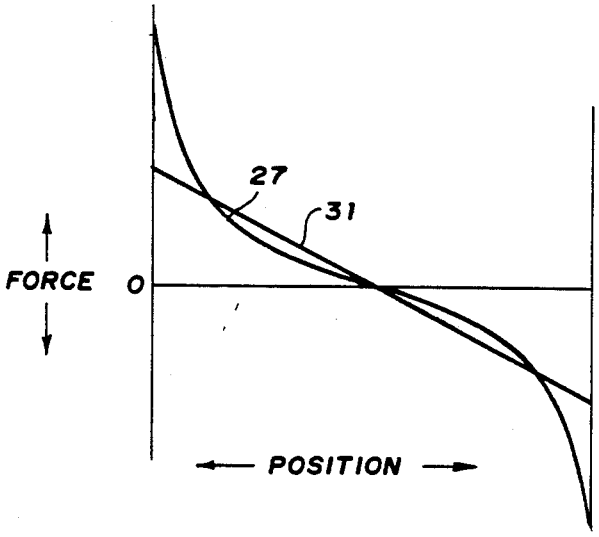
FIG. 7 is a diagram of force vs. position for the springs and magnetic circuits of the embodiments of FIGS. 1–5 showing the bistable nature of the apparatus.

Successful operation in the second mode of partial lift depends on the ability of the apparatus to bring the valve back from a stable half lift position to the closed position quickly and with moderate energy requirements. This appears possible in view of the curves of FIG. 12, in which the valve was successfully returned with a field aiding current of 40 amps. This and similar tests show that there is indeed sufficient force to pull the valve quickly back from the half lift position directly back into the closed position, with less energy than is required for full lift operation. This is due to a choice of springs with relatively low stiffness, as seen in FIG. 7, so that the magnetic force is never much different from the spring force except very near the valve open and full closed positions. The area between spring curve 31 and magnet curve 27 in one half of the FIG., which represents the energy required to bring the valve back to its closed position, is small. In fact, the energy input required for the second mode of partial lift is only 67 percent of that required for full lift operation, as compared with 79 percent for the first mode of partial lift operation. The second mode does not have the capability of such small valve open durations and lifts as the first does, due to the restriction on the half lift position; however, the lift is decoupled from the valve open duration, since the valve is stable in its half lift position and can be left there as long as desired before being closed.

It should be noted that either of the partial lift modes may be accomplished by applying coil closing currents to both coils 32 and 33 simultaneously but in opposite directions so that coil 33 tends to cancel the magnetic field of pole 25 and coil 32 tends to increase the magnetic field of pole 22. This, of course, requires a bidirectional current power supply and has not proven to be necessary in preliminary tests.

The embodiments of the invention in which an exclusive property or privilege is claimed are defined as follows:

1. The method of operating an electromechanical valve actuating device for an internal combustion engine in a partial lift mode, the valve actuating device actuating a valve movable between a closed position against a valve seat and a full open position away from the valve seat and comprising spring means effective to bias the valve toward a neutral position between the closed and open positions, permanent magnet means for each of the closed and full open positions effective to retain the valve in the respective closed or full open position as it approaches either and a coil associated with each of the permanent magnet means and effective, when supplied with an electric current, to produce a magnetic field superimposed on that of the respective permanent magnet means and thus effective to modify the magnetic attraction of the respective permanent magnet means on the valve, the method comprising the following steps:

establishing the valve in its closed position;

providing, at a predetermined valve opening time, an opening electric current to the coil associated with the permanent magnet means for the closed position of the valve in direction to reduce the magnetic field thereof and allow the spring means to accelerate the valve toward the fully open position;

stopping the opening electric current before the valve reaches its full open position; and providing, when the opening electric current is stopped and before the valve reaches its full open position, a closing electric current to one of the coils associated with the permanent magnet means for the full open and closed positions of the valve in direction and amount to modify the magnetic field thereof to cause the valve to be returned to its closed position, the valve open duration being determined at least in part by the time duration between the initiation of the opening electric current and the initiation of the closing electric current.

2. The method of claim 1 in which the closing electric current is applied to the coil associated with the permanent magnet means for the full open position and reduces the magnetic field thereof.

3. The method of claim 1 in which the closing electric current is applied to the coil associated with the permanent magnet means for the closed position in direction to increase the magnetic field thereof and is sufficient in amount that the increased magnetic field pulls the valve back into the closed position.

4. The method of claim 1 in which the closing electric current is applied to both coils associated with the permanent magnet means for the closed position in opposite directions in each of the coils to increase the magnetic field tending to move the valve to its closed position.

5. The method of claim 1 in which the opening electric current is in amount effective to substantially fully cancel the magnetic field of the permanent magnet means for the closed position of the valve and the closing electric current is initiated substantially concurrently with the stoppage of the opening electric current, the valve being opened to a position short of the full open position and immediately closing again in a continuous movement with valve lift linked with open duration.

6. The method of claim 1 in which the opening electric current is in amount less than that required for full cancellation of the magnetic field of the permanent magnet means for the closed position of the valve and is stopped before the valve reaches the neutral position so that the valve stops in a stable half lift position near the neutral position determined by the amount of the opening electric current and the friction characteristics of the valve, the valve lift being determined by said half lift position.

* * * * *